US007963799B1

(12) United States Patent
Lee et al.

(10) Patent No.: US 7,963,799 B1
(45) Date of Patent: Jun. 21, 2011

(54) CONNECTOR

(75) Inventors: Kuo-Chi Lee, Taipei County (TW); Chin-Huang Lin, Taipei County (TW)

(73) Assignee: Concraft Holding Co., Ltd., Grand Cayman (KY)

( * ) Notice: Subject to any disclaimer, the term of this patent is extended or adjusted under 35 U.S.C. 154(b) by 0 days.

(21) Appl. No.: 12/825,700

(22) Filed: Jun. 29, 2010

(30) Foreign Application Priority Data

Jun. 3, 2010 (TW) ..... 99210529 U

(51) Int. Cl.
*H01R 13/648* (2006.01)

(52) U.S. Cl. ..... 439/607.23; 439/701; 439/607.35; 439/541.5

(58) Field of Classification Search ..... 439/541.5, 439/607.2, 607.25, 701, 607.23, 607.35
See application file for complete search history.

(56) References Cited

U.S. PATENT DOCUMENTS

| | | | | |
|---|---|---|---|---|
| 6,863,569 | B2 * | 3/2005 | Zhu et al. | 439/607.27 |
| 7,025,632 | B2 * | 4/2006 | Hu et al. | 439/606 |
| 7,748,999 | B1 * | 7/2010 | Sun et al. | 439/607.36 |
| 2004/0229502 | A1 * | 11/2004 | Hu et al. | 439/541.5 |

* cited by examiner

*Primary Examiner* — Briggitte R Hammond
(74) *Attorney, Agent, or Firm* — Rosenberg, Klein & Lee

(57) ABSTRACT

A connector for a fiber channel switch includes an insulation body, a first terminal module and a second terminal module. The first terminal module and the second terminal module are integrated together to form a combination by buckling a first buckling element of the first terminal module and a second buckling element of the second terminal module. The combination is to plug into an assembly slot of the insulation body so as to form major parts of the connector.

7 Claims, 8 Drawing Sheets

CONNECTOR

This application claims the benefit of Taiwan Patent Application Serial No. 099210529, filed Jun. 3, 2010, the subject matter of which is incorporated herein by reference.

BACKGROUND OF THE INVENTION (1) Field of the Invention

The invention relates to an electric connector, and more particularly to an electric connector having an assembly-type terminal module.

(2) Description of the Prior Art

In the art, a fiber channel switch (or fiber channel hub) includes a number of electric connectors arranged in parallel, in which each of the connectors can match a prospective foreign connector. Referring to FIG. 1 and FIG. 1A, a typical electric connector for a conventional fiber channel switch is shown in a schematic planar view and an exploded view, respectively. As shown, the connector 1 includes an insulation body 10, a plurality of terminal modules 20 spaced electrically to each other, a separator 30 and a metal housing 40. Each of the terminal modules 20 is a plate structure having a substrate 21 and four terminals 22 fixed on the substrate 21.

While in assembling the connector 1, the terminal modules 20 are firstly arranged parallel to be set in the insulation body 10 in a manner that the upper pairing terminals 22 can be properly nested in a respective first slot 11 and the lower pairing terminals 22 can be also properly received inside a second slot 12 of the insulation body 10. Then, the separator 30 is plugged into the insulation body 10, and the metal housing is introduced to house the insulation body 10 and the separator 30. As shown, the connector 1 can match two foreign connectors, one for the first slot 11 and another for the second slot 12.

As shown in FIG. 1A, for a need to receive more foreign connectors, the connector 1 for the fiber channel switch requires broader substrates 21, both in width and length (S1). As the substrate 21 becomes broader, the terminals 22 arranged on the substrate 21 need more in length. In the art, the terminal 22 is punched, pressed or stamped from a raw metal sheet. In order to produce the lengthy terminals 22 so as able to be properly arranged on a broader substrate 21, it is inevitable that a broader raw metal sheet is required. Accordingly, to achieve such intent of accommodating more foreign connectors, the cost hike in preparing the broader substrates 21 and the raw metal sheets for producing the terminals 22 can be foreseen. Anyway, such a cost change is unwelcome. Therefore, to avoid such a cost increase upon the aforesaid corresponding improvement, a design change in the terminal arrangement of the connector is definitely desired by the skilled persons in the art.

SUMMARY OF THE INVENTION

Accordingly, it is an object of the present invention to provide a connector that introduces a fastener to mount a plurality of terminals along a predetermined arrangement direction and so as to form a terminal module that overcomes the aforesaid shortcomings of the conventional connectors.

In the present invention, the connector comprises an insulation body, a first terminal module and a second terminal module. The insulation body further includes a plug slot and an assembly slot located opposite to the plug slot, in which the plug slot is communicated in space with the assembly slot. The first terminal module further includes a plurality of first terminals, a first fastener and a first buckling element. The first terminals are arranged along a predetermined arrangement direction, and ends of these first terminals pointing at a same direction are exploded to the plug slot. The first fastener is to locate the first terminals in the assembly slot. The first buckling element is located at the first fastener.

The second terminal module further includes a plurality of second terminals, a second fastener and a second buckling element. The second terminals are arranged along the predetermined arrangement direction, and ends of the second terminals at the same direction are exploded to the plug slot. The second fastener is to locate the second terminals in the assembly slot. The second buckling element is located at the second fastener to be buckled with the first buckling element.

In the present invention, a combination of the first terminal module and the second terminal module is thus formed by buckling the first buckling element and the second buckling element. The combination is then plugged in the assembly slot along an assembly direction so as to be integrated with the insulation body, in which the assembly direction is perpendicular to the arrangement direction.

By structuring the aforesaid connector in accordance with the present invention, a raw metal sheet is able to produce more first and second terminals at the same metal sheet, such that residue material from the raw material can be substantial reduced. Further, in the connector, the required material for the fastener is less than that for the conventional substrates, and thereby the production cost for the connector can be greatly reduced.

All these objects are achieved by the connector described below.

BRIEF DESCRIPTION OF THE DRAWINGS

The present invention will now be specified with reference to its preferred embodiment illustrated in the drawings, in which.

DESCRIPTION OF THE PREFERRED EMBODIMENT

The invention disclosed herein is directed to a connector to be used in a fiber channel switch. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

Figure 2:
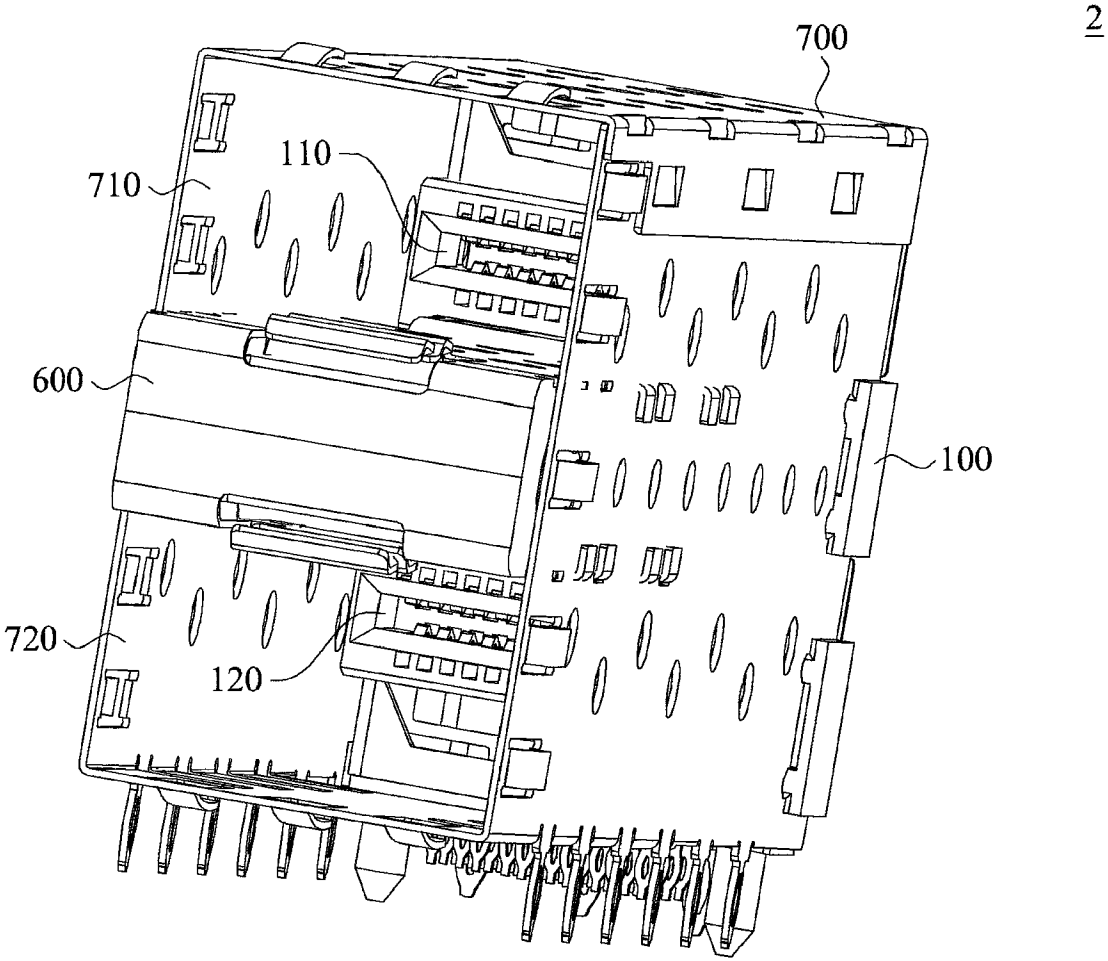
FIG. 2 is a perspective view of a preferred embodiment of the connector in accordance with the present invention.

Referring now to FIG. 2, a preferred connector in accordance with the present invention is perspective shown. The connector 2 can be utilized in a hub or a fiber channel switch. The connector 2 can include an insulation body 100, a spacer unit 600 and a metal housing 700. The metal housing 700 is used to cover both the insulation body 100 and the spacer unit 600, preferably in a wrap manner. Between the spacer unit 600 and the metal housing 700, there form a connection slot 710 and a connection sub-slot 720 respectively to an upper side and a lower side of the spacer unit 600. The connection slot 710 and the connection sub-slot are used to receive thereinside corresponding foreign connector (not shown in FIG. 2). In the present invention, the spacer unit 600 is not a necessary part and can be absent, upon when the connector 2 is used to match a foreign connector only. In particular, a plurality of connectors 2 can be orderly arranged inside the metal housing 700, such that a compatible number of foreign connectors can be handled in the metal housing 700.

Figure 3:
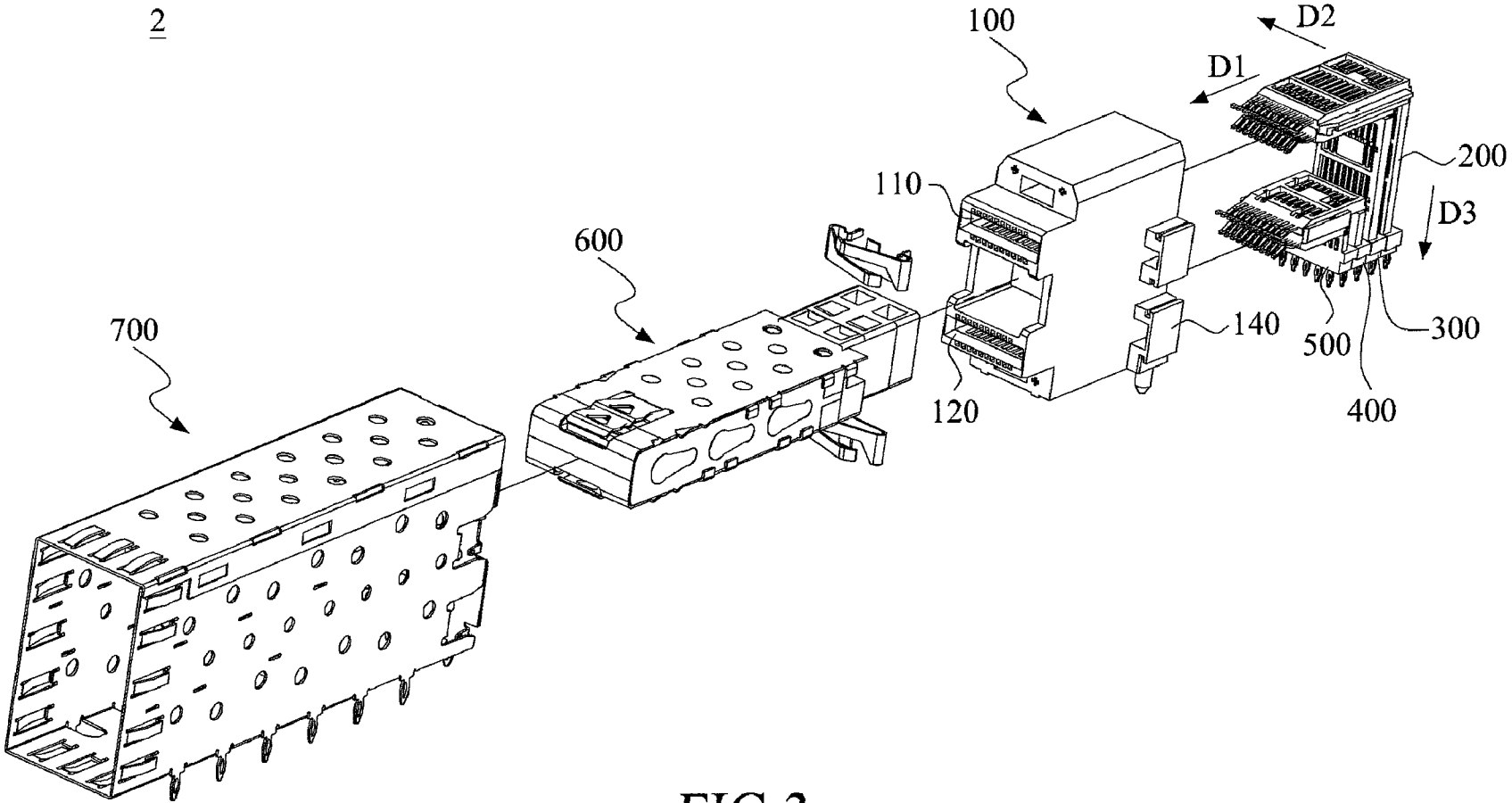
FIG. 3 is an exploded view of FIG. 2.
Figure 4:
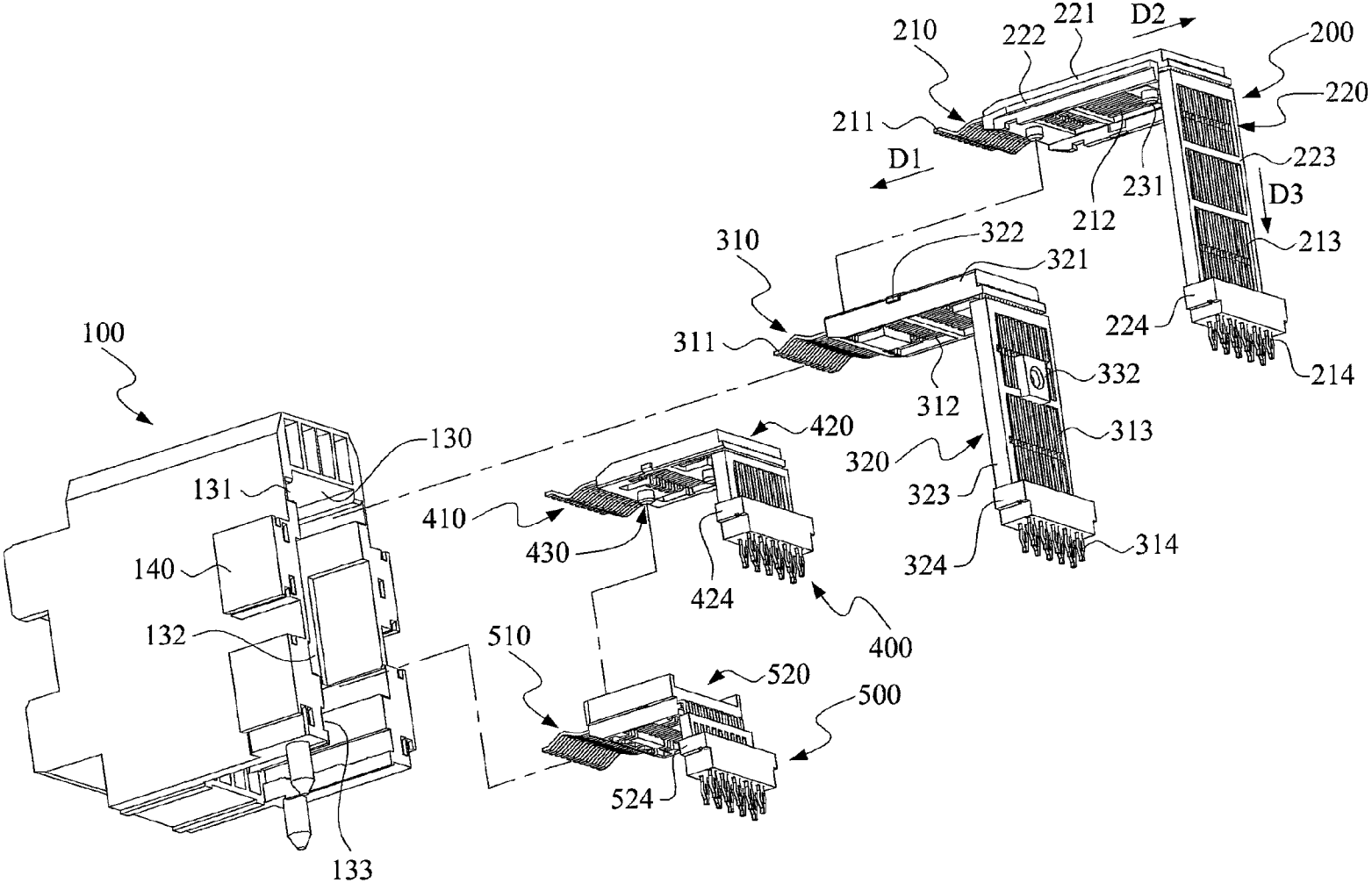
FIG. 4 is an exploded view of the insulation body and the terminal modules of FIG. 2.

Referring now to FIG. 3 and FIG. 4, exploded views of the connector are shown, particularly showing the insulation body 100 and the terminal modules of FIG. 2. The connector 2 includes the insulation body 100, a plurality of terminal modules, one spacer unit 600 and the metal housing 700. In this preferred embodiment, the terminal modules include a first terminal module 200, a second terminal module 300, a third terminal module 400 and a four terminal module 500.

The insulation body 100 is nested inside the metal housing 700. A front side of the insulation body 100 has a plug slot 110 and a plug sub-slot 120, while a rear side thereof has an assembly slot 130. Both the plug slot 110 and the plug sub-slot 120 are communicated in space with the assembly slot 130. Inside the assembly slot 130, two opposing inner sidewalls thereof are constructed with a sliding slot 131, a sliding sub-slot 132 and a base sliding slot 133; all of the three slots 131, 132 and 133 extending along an assembly direction D1. Corresponding lateral sides of the first fastener 220 and the second fastener 320 are to match thereinside with the sliding slot 131. As shown, the insulation body 100 has a pair of stop elements 140, located oppositely to two opposing sidewalls. Referred to FIG. 3, in assembling the connector, all the terminal modules are combined into a unique piece and then the combination is sent into the insulation body 100 by slipping along the assembly slot 130 and also along the assembly direction D1.

The spacer unit 600 is extended along the assembly direction D1 to plug into the insulation body 100 at the space between the plug slot 110 and the plug sub-slot 120. The spacer unit 600 is completely nested inside the metal housing 700.

Figure 1:
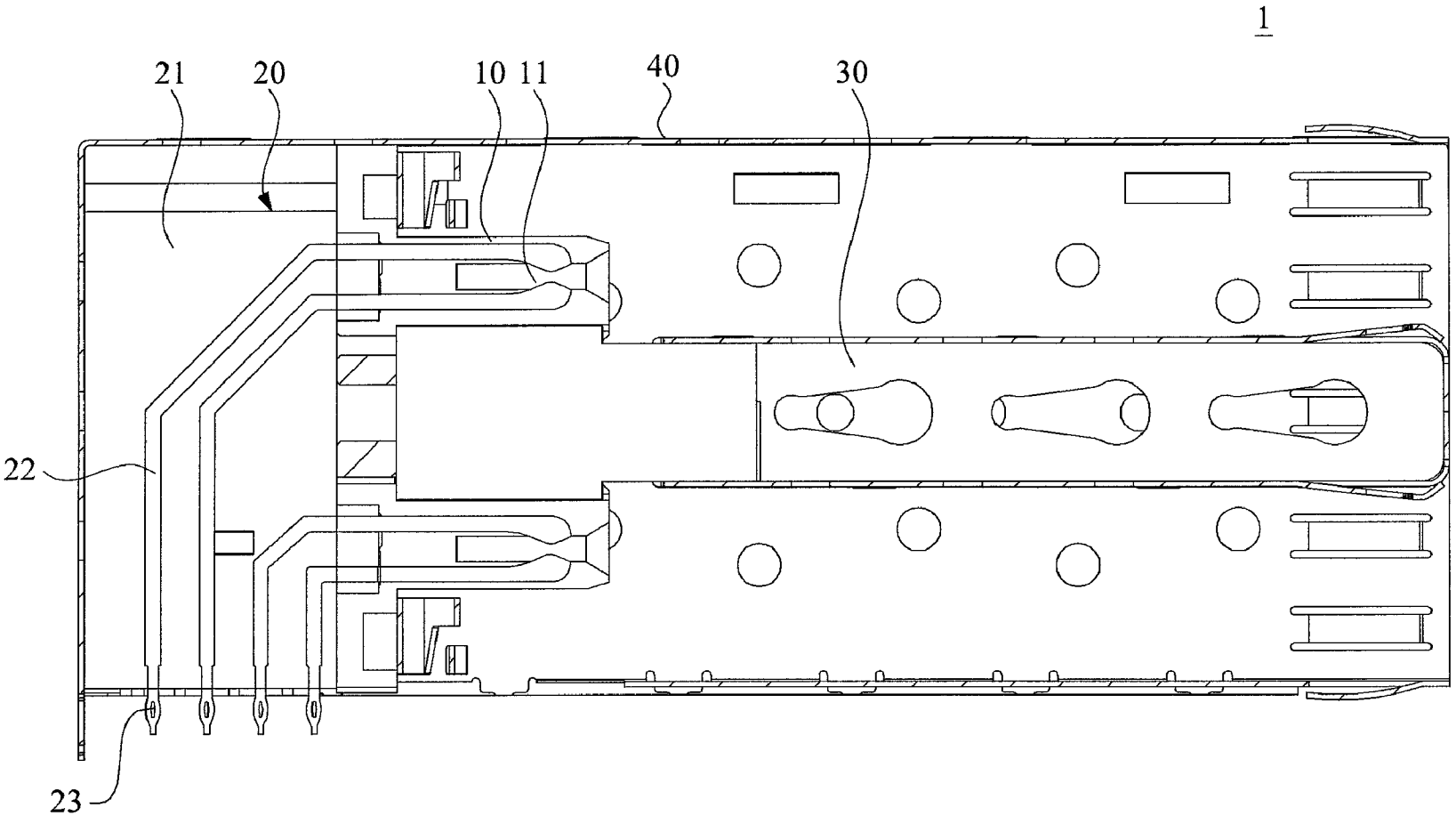
FIG.1(Prior Art)
FIG. 1 is a schematic planar view of a typical electric connector for a conventional fiber channel switch.
Figure 1A:
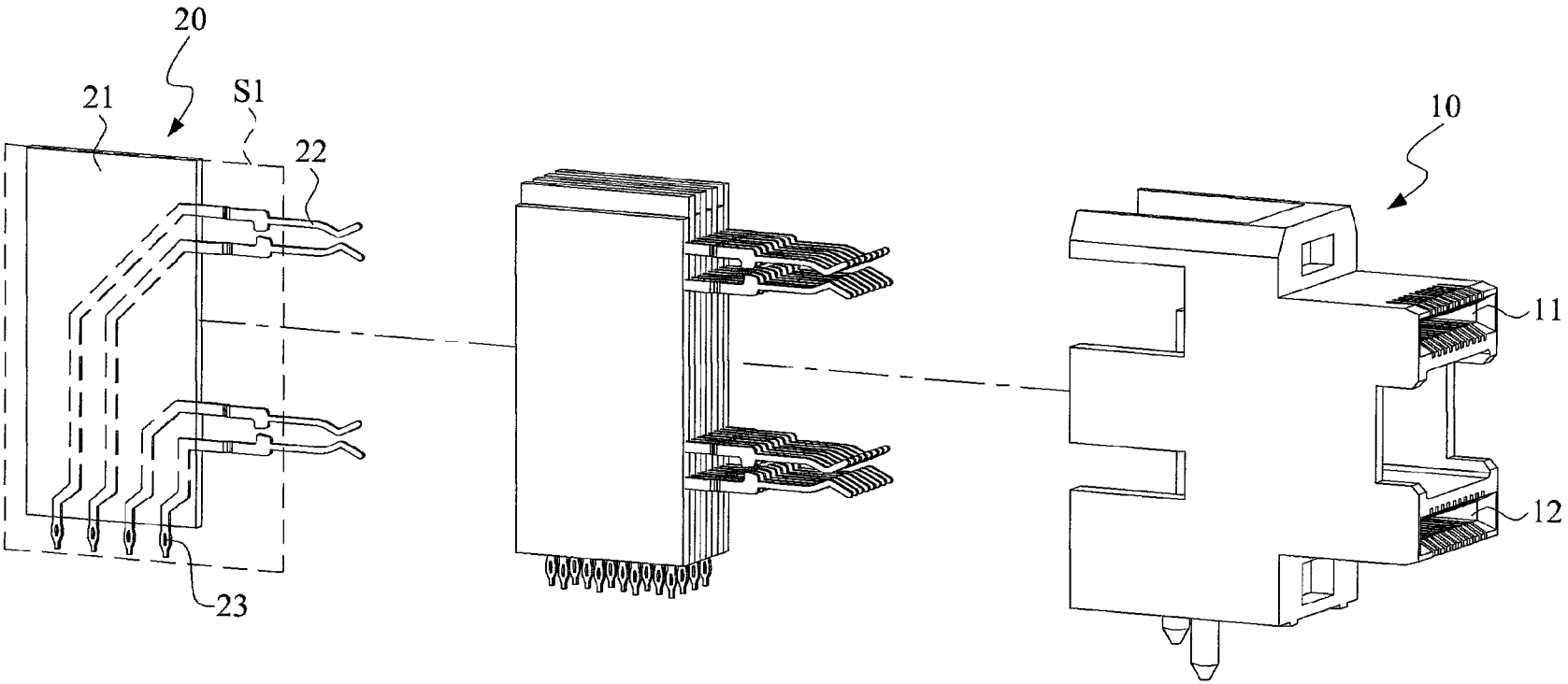
FIG.1A(Prior Art)
FIG. 1A is an exploded view of the electric connector of FIG. 1.

In the present invention, the metal housing 700 can be a hollow cylindrical shell extended along the assembly direction D1. The metal housing 700 is to wrap and shield thereinside the spacer unit 600 and the insulation body 100. In an assembly state, the stop element 140 of the insulation body 100 is stopped properly against a lateral wall of the metal housing 700, while the lateral sidewall of the spacer unit 600 is contacted against an inner wall of the metal housing 700. Upon such an arrangement, the connection slot 710 and the connection sub-slot 720 can be formed inside the metal housing 700, as shown in FIG. 1.

Figure 5:
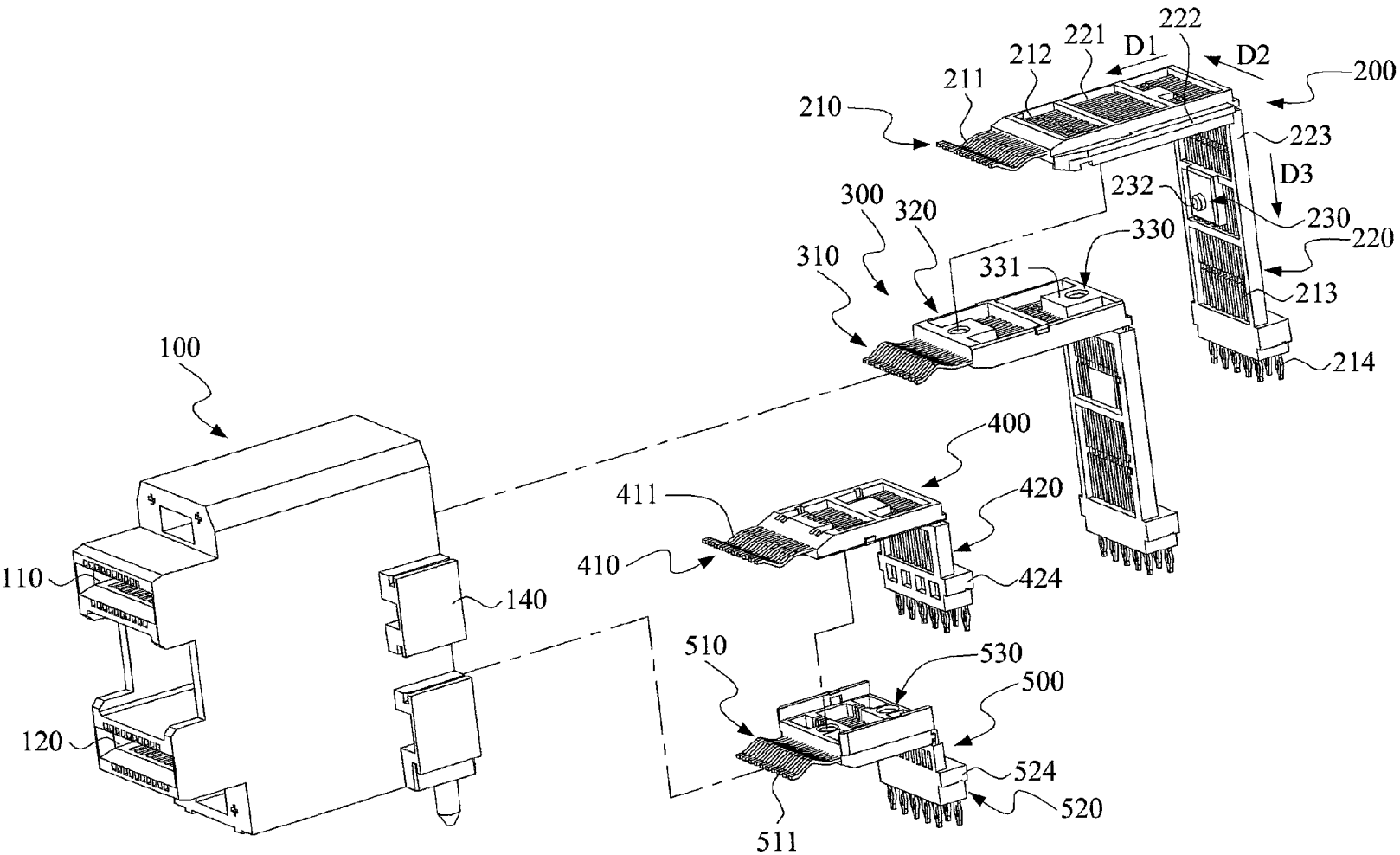
FIG. 5 is another view of FIG. 4.

Referred now to FIG. 4 and FIG. 5, exploded views are used to illustrate the insulation body and the terminal modules in accordance with the present invention. As shown, the first terminal module 200 includes a plurality of the first terminals 210, a first fastener 220 and a first buckling element 230.

The first terminals 210 are L-shape formed and arranged along an arrangement direction D2. Each of the first terminals 210 has, in a geometrical or extending order, a contact end 211, a horizontal section 212, a vertical section 213 and a locating end 214. The contact end 211 is to expose out of the plug slot 110. The horizontal section 212 is extended along the assembly direction D1. The vertical section 213 is extended along an extension direction D3, which can be perpendicular to the assembly direction D1.

The first fastener 220 is to fix the first terminals 210 and to be integrated into the assembly slot 130. The first buckling element 230 is located at a lower portion of the first fastener 220. In the embodiment as shown, the first fastener 220 can further include a first primary fastening element 221 and a first secondary fastening element 223. The first buckling element 230 can further include at least one first primary buckling part 231 and at least one first secondary buckling part 232. The first primary fastening element 221 is extended along the assembly direction D1 to cover and fix the horizontal section 212 of each of the first terminals 210. The first primary buckling part 231 can be constructed at a lower surface of the first primary fastening element 221. The first secondary fastening element 223 extended along the extension direction D3 is to cover and fix the vertical section 213 of each of the first terminals 210. The first secondary buckling part 232 can be located at a front surface of the first secondary fastening element 223. Further, the first primary fastening element 221 can have a pair of first sliding blocks 222 located to opposing sides thereof. The first secondary fastening element 223 can have a pair of constraint blocks 224 located to opposing sides of a bottom portion of the first secondary fastening element 223.

The second terminal module 300 includes a plurality of second terminals 310, a second fastener 320 and a second buckling element 330.

The second terminals 310 are L-shape formed and arranged along the arrangement direction D2. Each of the second terminals 310 has, in a geometrical or extending order, a contact end 311, a horizontal section 312, a vertical section 313 and a locating end 314. The contact end 311 is to expose out of the plug slot 110. The horizontal section 312 is extended along the assembly direction D1. The vertical section 313 is extended along the extension direction D3, which can be perpendicular to the assembly direction D1.

The second fastener 320 parallel to the first fastener 220 is to fix the second terminals 310 and to be integrated into the assembly slot 130. The second buckling element 330 is located at an upper portion of the second fastener 320 to buckle with the first buckling element 230. Through buckle-up of the first buckling element 230 and the second buckling element 330, the first terminal module 200 and the second terminal module 300 can be integrated into a unique piece to anchor inside the assembly slot 130, and thus can be combined into the insulation body 100.

In the embodiment as shown, the second fastener 320 can further include a second primary fastening element 321 and a second secondary fastening element 323, parallel to the first primary fastening element 221 and the first secondary fastening element 223, respectively. The second buckling element 330 can further include at least one second primary buckling part 331 and at least one second secondary buckling part 332. The second primary fastening element 321 is extended along the assembly direction D1 to cover and fix the horizontal section 312 of each of the second terminals 310. The second primary buckling part 331 can be constructed at an upper surface of the second primary fastening element 321. The second secondary fastening element 323 extended along the extension direction D3 is to cover and fix the vertical section 313 of each of the second terminals 310. The second secondary buckling part 332 can be located at a rear surface of the second secondary fastening element 323.

In the present invention, it is easy to see that the material and occupation required for the fasteners are less than that for the conventional substrates, and thereby a substantial save in production cost is relevantly achieved.

Further, the second primary fastening element 321 can have a pair of second buckling elements 322 located to opposing sides thereof for matching the first sliding blocks 222. The second secondary fastening element 323 can have a pair of constraint blocks 324 located to opposing sides of a bottom portion thereof. In an assembly state into a unique piece of the first terminal module 200 and the second terminal module 300, the first primary fastening element 221 is engaged with the second primary fastening element 321 through buckling the first primary buckling part 231 with the second primary buckling part 331, the first secondary fastening element 223 is engaged with the second secondary fastening element 323 through buckling the first secondary buckling part 232 with the second secondary buckling part 332, and the second buckling element 322 is buckled with the first sliding block 222. As shown in FIG. 3, the constraint blocks 224 and 324 are arranged along the assembly direction D1. The first terminal module 200 and/or the second terminal module 300 is inserted into the assembly slot 130 along the assembly direction D1. The first sliding block 222 is slipped along the sliding slot 131 till a firmly engagement in between is achieved. Also, the constraint blocks 224 and 324 are slipped along the base sliding slot 133 and to be anchored thereinside. In a final state of this assembly, ends 211 of the first terminals 210 and ends 311 of the second terminals 310 are exposed out of the plug slot 110.

The third terminal module 400 includes a plurality of third terminals 410, a third fastener 420 and a third buckling element 430. The third terminals 410 are arranged along the arrangement direction D2. One end of each of the third terminals 410 is exposed out of the plug sub-slot 120. The third fastener 420 is to fasten and to locate the third terminals 410 inside the assembly slot 130. The third buckling element 430 is constructed properly at the third fastener 420.

The fourth terminal module 500 includes a plurality of fourth terminals 410, a fourth fastener 520 and a fourth buckling element 530. The fourth terminals 510 are arranged along the arrangement direction D2. One end of each of the fourth terminals 510 is exposed out of the plug sub-slot 120. The fourth fastener 520 is to fasten and to locate the fourth terminals 510 inside the assembly slot 130. The fourth buckling element 530 is constructed properly at the fourth fastener 520 to engage the third buckling element 430.

The third terminal module 400 and the fourth terminal module 500 are integrated by buckling the third buckling element 430 and the fourth buckling element 530, and then the combination is inserted into the assembly slot 130 so as to be assembled with the insulation body 100. For structural similarity exists between the combination of the third terminal module 400 and the fourth terminal module 500 and that of the first terminal module 200 and the second terminal module 300, details of the third terminal module 400 and the fourth terminal module 500 can be easily understood by referring to the aforesaid description upon the first terminal module 200 and the second terminal module 300, as shown in FIG. 4 and FIG. 5.

After the third fastener 420 is fixed to the fourth fastener 520 by buckling the third buckling element 430 and the fourth buckling element 530, the third terminal module 400 and the fourth terminal module 500 can be formed integrally. The constraint blocks 424 and 524 are aligned with the assembly direction D1, as shown in FIG. 3. Then, the combination of the third terminal module 400 and the fourth terminal module 500 can be inserted into the assembly slot 130 along the assembly direction D1. At this stage, the third terminal module 400 is slipped along and finally anchored in the sliding sub-slot 132. The constraint blocks 424 and 524 can slip along the base sliding slot 133 till to be rested and fixed thereinside. In a complete stage of this assembly, contact ends 411 of the third terminals 410 and contact ends 511 of the fourth terminals 510 are all exposed to the plug sub-slot 120.

Figure 6:
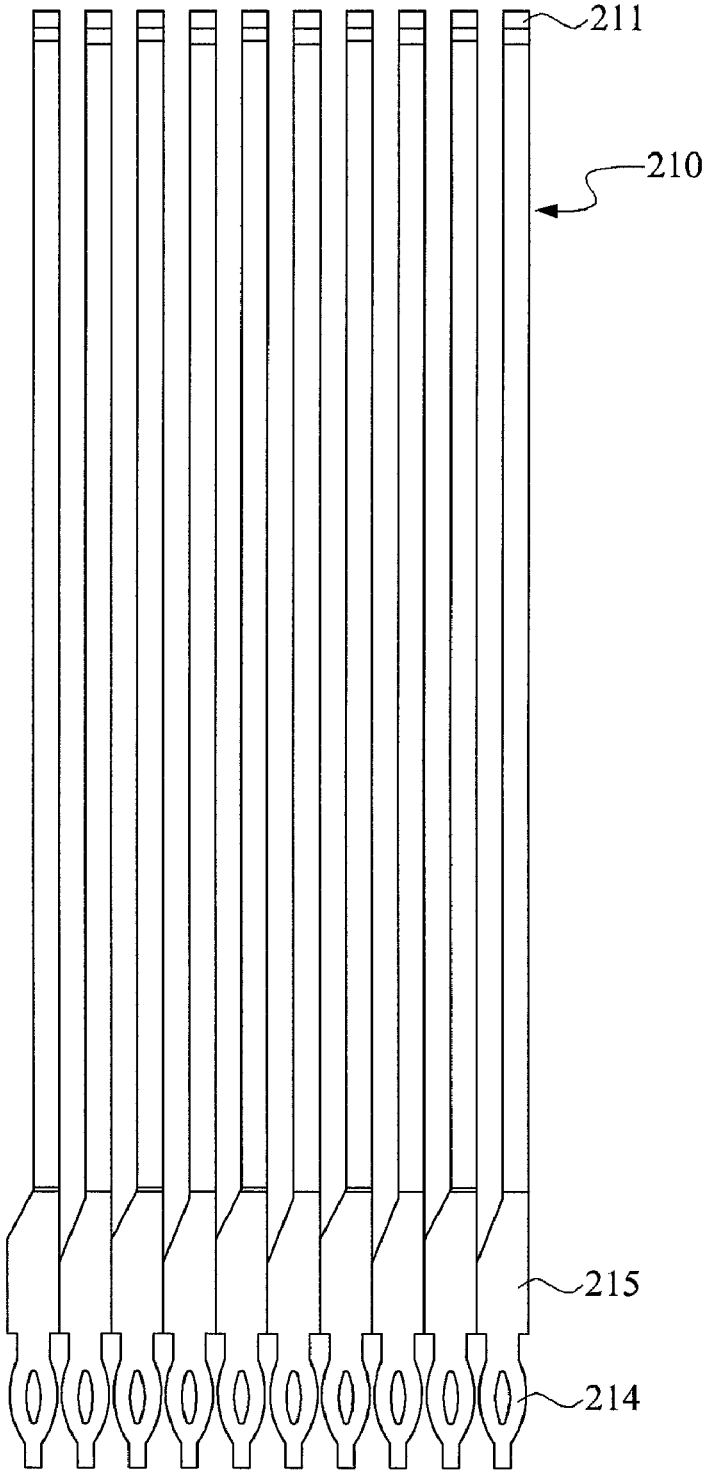
FIG. 6 shows schematically a set of first terminals of the present invention prior to the assembly.

In the aforesaid description, each locating end of any of the first terminals 210, the second terminals 310, the third terminals 410 and the fourth terminals 510 can be formed as a ring end parallel to the arrangement direction D2. To the skilled person in the art, he/she can recognizes that the first terminals 210, the second terminals 310, the third terminals 410 and the fourth terminals 510 can be cut from a metal sheet and then bent into form. Referred to FIG. 6, the typical first terminal 210 can be a straight metal strip prior to a proper bent operation. A number of the first terminals 210 can be produced, in a parallel formation, from the same raw metal sheet. While in arranging the production, an intern connection strip 215 can be used to adjoin all the locating ends 214 of the first terminals 210. In a final production step of the first terminals 210, the connection strip 215 can then be cut away and the locating ends 214 can be bent back and forth in an interval manner so as to facilitate the following soldering of the first terminals 210.

Figure 7:
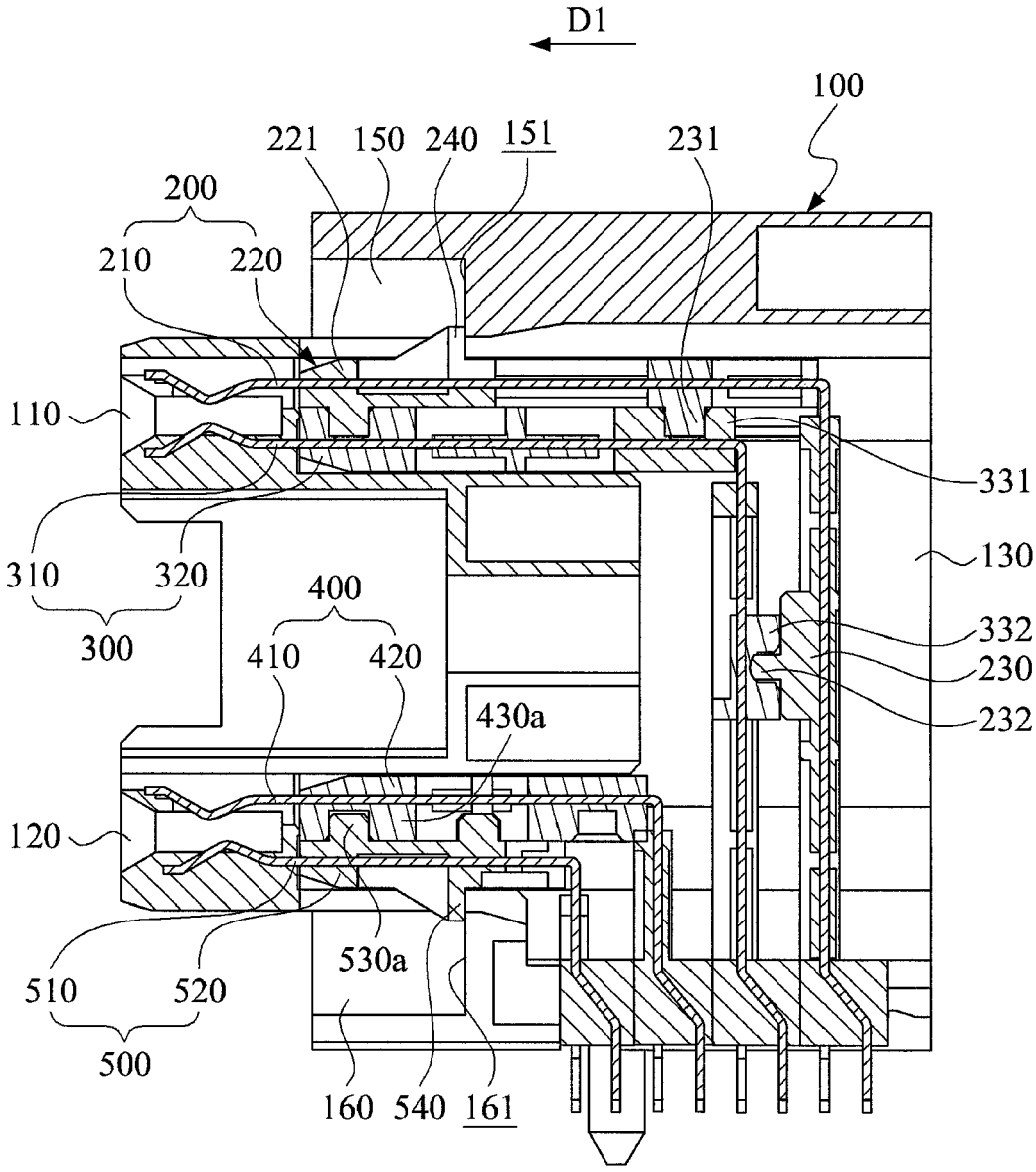
FIG. 7 illustrates a schematic cross-section view of another connector in accordance with the present invention.

Referring now to FIG. 7, a cross-sectional view of a second embodiment of the connector in accordance with the present invention is present. Major differences between the second embodiment and the previous embodiment include: the first terminal module 200 further including a first constraint element 240 protruded from the first primary fastening element 221 of the first fastener 220, the fourth terminal module 500 further including a second constraint element 540 protruded from the fourth fastener 520, and the insulation body 100 further including a constraint slot 150 and a constraint sub-slot 160.

As shown in FIG. 7, all the first terminal module 200, the second terminal module 300, the third terminal module 400 and the further terminal module 500 are inserted into the assembly slot 130 along the assembly direction D1, and thus integrated with the insulation body 100. The first constraint element 240 is fixed inside the constraint slot 150 with a constraint sidewall 151 thereof, and the second constraint element 540 is fixed inside the constraint sub-slot 160 with another constraint sidewall 161 thereof. Upon such and arrangement, the first terminal module 200, the second terminal module 300, the third terminal module 400 and the further terminal module 500 can be firmly held inside the insulation body 100.

Further, in this second embodiment, the third buckling element 430*a* can be formed as a groove structure, and the fourth buckling element 530*a* can be formed as a respective block structure. (Note that in the first embodiment the third buckling element 430 is a block and the fourth buckling element 530 is a groove.)

By providing the terminals of the present invention, more terminals can be produced from the same raw metal sheet, and thus substantial cost saving in the production can be achieved. Also, the design of the conventional substrate is omitted in this invention, and thus contribute to another cost down in production the connector.

While the present invention has been particularly shown and described with reference to a preferred embodiment, it will be understood by those skilled in the art that various changes in form and detail may be without departing from the spirit and scope of the present invention.

We claim:

1. A connector, comprising:

an insulation body, having thereof a plug slot and an assembly slot located opposite to the plug slot, the plug slot being communicated in space with the assembly slot;

a first terminal module, further including:

a plurality of first terminals arranged along a predetermined arrangement direction, ends of the first terminals at the same direction being exploded to the plug slot;

a first fastener for locating the first terminals in the assembly slot; and a first buckling element located at the first fastener;

a second terminal module, further including:

a plurality of second terminals arranged along the predetermined arrangement direction, ends of the second terminals at the same direction being exploded to the plug slot;

a second fastener for locating the second terminals in the assembly slot; and a second buckling element located at the second fastener and buckled with the first buckling element;

a metal housing extended along an assembly direction to wrap said insulation body; and a spacer unit extended along said assembly direction and covered by said housing, said insulation body further having a plug sub-slot, the spacer unit being located between the plug sub-slot and said plug slot wherein a combination of the first terminal module and the second terminal module is made by buckling the first buckling element and the second buckling element, the combination is plugged in the assembly slot along said assembly direction so as to be integrated with the insulation body, and the assembly direction is perpendicular to the arrangement direction.

2. The connector according to claim 1, wherein each of said first and second terminals have a contact end, a horizontal section, a vertical section and a locating end, said contact end being exposed out of said plug slot, said horizontal section extending along said assembly direction, said vertical section extending along an extension direction, which is perpendicular to said assembly direction, each locating end of any of said first and the second terminals having a portion thereof with a ring shaped contour.

3. The connector according to claim 1, wherein said first fastener is parallel to said second fastener, said first buckling element is located at a lower portion of said first fastener, and said second buckling element is located at an upper portion of said second fastener.

4. The connector according to claim 1, further comprising:

a third terminal module, further including:

a plurality of third terminals arranged along said predetermined arrangement direction, ends of the third terminals at the same direction being exploded to said plug sub-slot;

a third fastener for locating the third terminals in said assembly slot; and a third buckling element located at the third fastener; and a fourth terminal module, further including:

a plurality of fourth terminals arranged along said predetermined arrangement direction, ends of the fourth terminals at the same direction being exploded to said plug sub-slot;

a fourth fastener for locating the fourth terminals in said assembly slot; and a fourth buckling element located at the fourth fastener and buckled with the third buckling element;

wherein a combination of the third terminal module and the fourth terminal module is made by buckling the third buckling element and the fourth buckling element, and the combination is plugged in said assembly slot so as to be integrated with said insulation body.

5. The connector according to claim 4, wherein said first terminal module further includes a first constraint element protruded from said first fastener, said fourth terminal module further includes a second constraint element protruded from said fourth fastener, said insulation body further includes a constraint slot and a constraint sub-slot, the first constraint element is fixed inside the constraint slot, and the second constraint element is fixed inside the constraint sub-slot.

6. A connector, comprising:

an insulation body, having thereof a plug slot and an assembly slot located opposite to the plug slot, the plug slot being communicated in space with the assembly slot, said assembly slot of said insulation body having a sidewall, said sidewall further including a sliding slot extended along an assembly direction;

a first terminal module, further including:

a plurality of first terminals arranged along a predetermined arrangement direction, ends of the first terminals at the same direction being exploded to the plug slot;

a first fastener for locating the first terminals in the assembly slot, a lateral edge of said first fastener being located in the sliding slot; and a first buckling element located at the first fastener, said first buckling element being located at a lower portion of said first fastener; and a second terminal module, further including:

a plurality of second terminals arranged along the predetermined arrangement direction, ends of the second terminals at the same direction being exploded to the plug slot;

a second fastener for locating the second terminals in the assembly slot, said first fastener being parallel to said second fastener; and a second buckling element located at the second fastener and buckled with the first buckling element, said second buckling element being located at an upper portion of said second fastener;

wherein a combination of the first terminal module and the second terminal module is made by buckling the first buckling element and the second buckling element, the combination is plugged in the assembly slot along an assembly direction so as to be integrated with the insulation body, and the assembly direction is perpendicular to the arrangement direction.

7. A connector, comprising:

an insulation body, having thereof a plug slot and an assembly slot located opposite to the plug slot, the plug slot being communicated in space with the assembly slot, said insulation body further including a constraint slot;

a first terminal module, further including:

a plurality of first terminals arranged along a predetermined arrangement direction, ends of the first terminals at the same direction being exploded to the plug slot;

a first fastener for locating the first terminals in the assembly slot; and a first buckling element located at the first fastener; and a first constraint element protruded from said first fastener, said first constraint element being fixed inside said constraint slot;

a second terminal module, further including:

a plurality of second terminals arranged along the predetermined arrangement direction, ends of the second terminals at the same direction being exploded to the plug slot;

a second fastener for locating the second terminals in the assembly slot; and a second buckling element located at the second fastener and buckled with the first buckling element;

wherein a combination of the first terminal module and the second terminal module is made by buckling the first buckling element and the second buckling element, the combination is plugged in the assembly slot along an assembly direction so as to be integrated with the insulation body, and the assembly direction is perpendicular to the arrangement direction.

* * * * *